United States Patent [19]

Heydorn

[11] 4,057,871

[45] Nov. 15, 1977

[54] CLEANING DEVICE FOR CAVITIES PREFERABLY IN CHILL MOULDS FOR STEEL INGOTS

[75] Inventor: Walter Emil Erich Heydorn, Hallefors, Sweden

[73] Assignee: Ingenjorsfirman R. Ohrnell AB, Karlstad, Sweden

[21] Appl. No.: 738,399

[22] Filed: Nov. 3, 1976

[30] Foreign Application Priority Data

Nov. 3, 1975 Sweden ..... 7512258

[51] Int. Cl.[2] ..... B67C 1/08; A46B 7/02

[52] U.S. Cl. ..... 15/56; 15/104.1 C; 15/165

[58] Field of Search ..... 15/56–58, 15/71, 72, 101, 104.1 C, 246.5, 165, 212, 21 R

[56] References Cited

U.S. PATENT DOCUMENTS

| | | | |
|---|---|---|---|
| 2,556,389 | 6/1951 | Darrah | 15/72 |
| 2,628,379 | 2/1953 | Darrah | 15/72 |
| 3,992,745 | 11/1976 | Laurila | 15/56 |

*Primary Examiner*—Edward L. Roberts

[57] ABSTRACT

A cleaning device for cavities, particularly in chill moulds for steel ingots, is desired comprising a body provided with cleaning means by way of example brushes which face away from said body and are expandable away from each other in order to engage the walls of the cavity which is to be cleaned by displacement of the body to and fro along the walls of the cavity. The cleaning means are carried by outer arms in a pivotable way carried by levers having upper and lower ends with the cleaning means mounted on the lower ends, the levers being mounted in bearings on the body. Springs are arranged to pivot the external ends of the lever arms outwardly away from the body and to pivot the cleaning means inwardly toward the body so that the cleaning means in an otherwise unactuated position form an oblique angle to the direction of displacement.

3 Claims, 2 Drawing Figures

CLEANING DEVICE FOR CAVITIES PREFERABLY IN CHILL MOULDS FOR STEEL INGOTS

Figure 1:
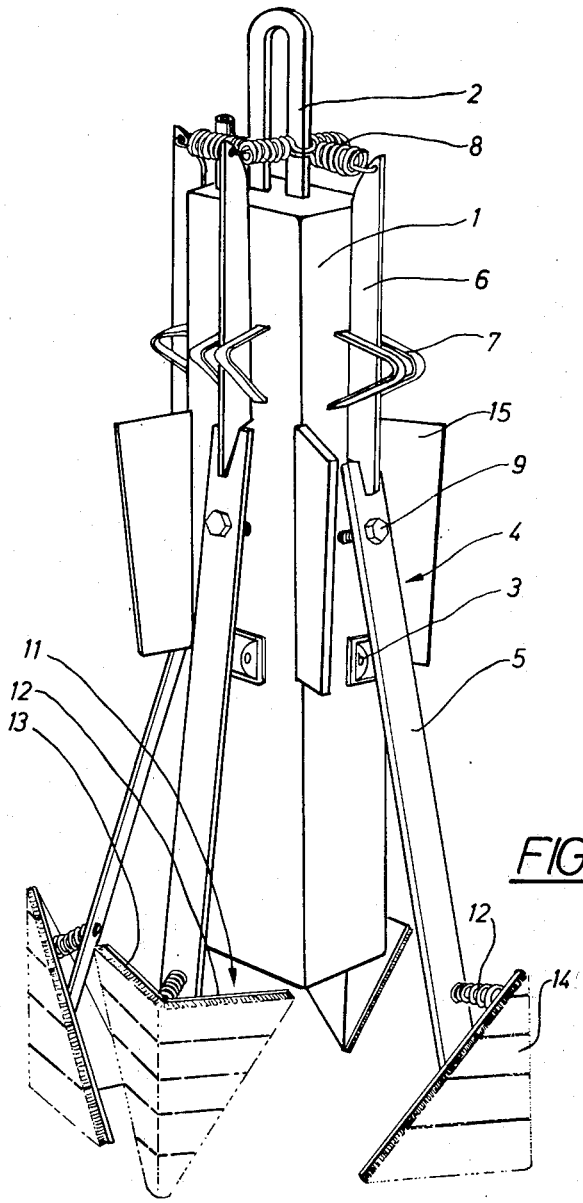

The present invention relates to a cleaning device for cavities, preferably in chill moulds for steel ingots, comprising elements extending from a body and supporting cleaning means, by way of example brushes, which face away from said body, said elements being connected with the body by means of a device which is arranged to permit the elements to expand away from each other in order to engage the walls of the cavity, which is the object of the cleaning which is intended to be performed by displacement of the body in a working direction along the walls of the cavities.

A cleaning device for moulds is known from French Patent specification No. 1,319,862. The device comprises a number of brushes mounted in sockets, which are arranged to permit them to expand away from each other. By such expansion the brushes can be brought to engage the walls of the cavities of the mould and in a certain degree to adjust themselves to different dimensions of the cavity. The expansion can be brought about by means of a great number of links which form a link system at the centre of the device. Due to the relatively great number of elements in the link system, the manufacturing cost of the same is comparatively high while at the same time a considerable drawback of the device in question is that it tends to become contaminated during cleaning. Because of the fact that the link system is located at the centre of the device, it is moreover not very accessible for cleaning and service work.

Another cleaning unit for chill moulds is known from Swedish application for patent No. 7401686-6. Also this device is provided with brushes, which can expand from each other. In this case the expansion is brought about by means of power means actuated by a pressure medium. The introduction of power means with the necessary controlling conduits, the controls and the power source signifies a considerable cost and a risk of shutdowns which involves complications.

It is an object of the invention to provide a cleaning device of very simple and robust design being provided with only a small number of bearing points, which are easily accessible.

It is another object of the invention to provide a cleaning device, which easily and without any special operative manipulations can be introduced into a cavity, even if such a cavity exhibits a sharp entrance edge.

Still another object by the invention is to obtain, by means of a cleaning device wth expansion means coverage of the entire surfaces intended to be cleaned without any intermediate space within the whole range of expansion.

The objects of the present invention are accomplished by means of a cleaning device for cavities, preferably chill molds for steel ingots, comprising an elongated support body, a plurality of lever means each having an upper end and a lower end, means on said body for pivotally mounting said lever means intermediate said ends about an axis perpendicular to the axis of said body, an elongated cleaning means pivotally mounted on the lower end of each of said lever means for pivotal movement about an axis parallel to the axis of said mounting means, each of said cleaning means having a cleaning surface facing away from said body, the said mounting means permitting the lower end of said lever means and said cleaning means mounted thereon to expand outwardly, first spring means connected to said lever means to normally pivot said lower ends of said lever means outwardly from said body, second spring means connected between said cleaning means and said lever means to pivot said cleaning means so that the lower ends of said cleaning means extend inwardly toward said body forming an oblique angle, with the axis of said body when said cleaning means are out of contact with the interior surface of a mold.

An embodiment of the invention is illustrated in the accompanying drawings, in which FIG. 1 is a perspective side elevational view of the cleaning device.

Figure 2:
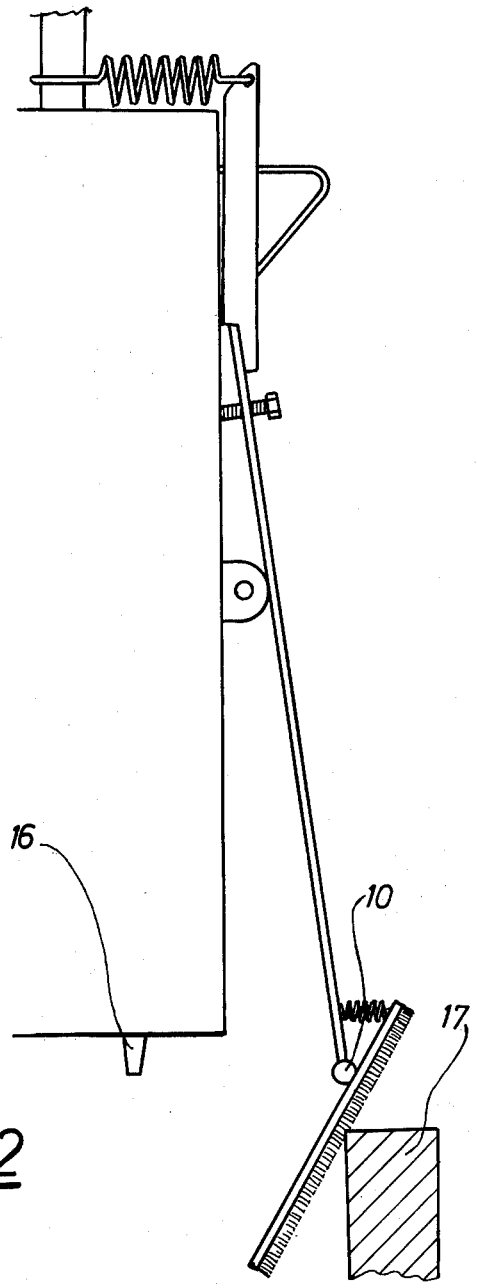

In FIG. 2 the device is shown in a schematic side elevational view.

According to FIG. 1 the device is formed of an elongated square central body 1, the upper end of which in the position of use is provided with a lifting eye 2. The central body 1 on its four sides carries block bearings 3, in which elongated arms 4 are journalled on shafts, which in the position of use occupy a horizontal position. Each one of the arms 4 comprises a lower flat part 5, which is adjacent to said block bearing and an upper likewise flat part 6, which forms an angle with respect to the part 5. The part 6 is guided in a fork 7 and at its upper end terminates a point of attachment for a tension spring 8, four tension springs for the arms 4 extending from the centre of the central body 1. The lower part of arms 4 above the block bearing 3 carries a set screw 9, respectively which can abut against the central body 1. At its lower end the part 5 exhibits a bearing 10 (FIG. 2), in which a brush holder 11 is journalled on a shaft, which is parallel to the axis of the block bearing 3. A pressure spring 12 is pressure fitted between the arm portion 5 and the upper portion of the brush holder 11.

The brush holders 11 are shaped with a contour, as seen in the longitudinal direction of the central body 1, which is adapted to the contour of the cavity, preferably a chill mould, which is to be cleaned. In the embodiment according to FIG. 1 it is assumed that the cavity is of square or rectangular cross section, and in accordance therewith the contour of each one of the brush holders 11 forms parts of two juxtapositioned sides of said square or rectangle. Thus, the brush holders 11 in FIG. 1 have two sides 12 and 13, which form a right angle to each other. Each one of these sides 12, 13 forms a right angled triangle, the apex of which is pointing in downwards direction for every other holder 11 and in upwards direction for the intermediate holders. By varying the contours of the holders 11 they can be adapted also to clean cavities of other cross sections than square ones, by way of example round or hexagonal ones. In case of a complicated shape of the cross section the number of arms 4 can be greater than four. The brush holders are arranged to carry a plurality of brushes, which is best split up in several elements 14, preferably in the form of steel brushes, which are arranged to be fastened by means of fastening elements such as screws.

It should further be mentioned that the central body 1 is provided with fenders 15 extending from its corners which serve the purpose of impeding the bearing and guiding points of the arms 4 from contacting with the wall of the cavity by lateral movements of the device. As illustrated in FIG. 2, the central body at its lower end can be provided with one or several nozzles 16 for compressed air, which by means of conduits, not shown, are connected with a source of compressed air, so that cleaning by an air jet can take place at the same time as the mechanical cleaning with the brush elements 14. As an alternative the central body 1 can be equipped with suction means. It should be noted that the central body 1 terminates a certain distance above the brushing means 11, 14. By this arrangement the stud that often projects upwards from a point at the bottom of a chill mould does not constitute any obstacle to the insertion of the brushing means all the way down to the lower edge of the lateral surfaces. The whole device has such a weight that it can pull the device downwards in the cavity in connection with the cleaning operation against the resistance arising, when the brushing means engage the wall.

When the device is used, it is suspended by means of the lifting eye 2 in a lifting hook carried by a travelling hoist or similar device. Thereby the arms 4 and the brush holders 14 occupy the positions, as is most clearly evident from FIG. 2. In this position, due to the bias of the tension springs 8, the distal ends of the arms 4 located below the block bearings 3 are pulled in outwardly direction, while the lower portion of the brush holders 14 are pivoted in inwardly direction due to the bias of the pressure springs 12. After the device has been lifted up, it is guided to a position above the upwards facing orifice of the cavity, which is to be cleaned. This is illustrated in FIG. 2 by the edge of a chill mould 17. The movement of the outwardly pivoting of the arms 4, which can be adjusted by means of the screws 9 and of the inwardly pivoting of the brush elements 14 are adjusted in such a manner that the lower edges of the brush holders with a good margin are inside of the edge of the orifice of the chill mould 17 and form in this manner an insertion cone. Thus, at the insertion the brush holders 11 can without difficulty get over the edge of the orifice notwithstanding that the arms are stretched open to such an extent that a complete engagement of the walls of the cavity is secured in the lowered down position of the device.

During the continued lowering down of the cleaning device the arms 4 on account of the pressure of the brush holders 11 against the wall of the cavity wall will gradually pivot inwardly, and at the same time, when the whole surfaces of the brushes engage the wall, said brush holders will adjust themselves to a complete engagement of the surface of the wall. When brought together in working position the brushes are adapted in such a manner that the upper edge of one brushing means will overlap the lower edge of the next following brushing means. This is made possible by virtue of the fact that the brushing surfaces are triangular in shape and are so arranged that the bases of said surfaces alternatively face upwards and downwards respectively.

As seen in the direction from the end of the cleaning device, the brush surfaces by virtue of said overlapping form an unbroken contour. During the cleaning operation, which takes place in such a manner that the device is raised and lowered by means of the aforesaid hoist, in which it is suspended, the brushing means will be dragged in an upwardly and downwardly direction along the inner surfaces of the chill mould. Thereby soot and scale is removed and collected at the bottom of the chill mould. As mentioned the device can be equipped with nozzles for cleaning by means of an air jet or suction means, so that the removed material can be blown or suctioned away out of the chill mould. As has been mentioned, most chill moulds for castings are provided with a hole in the bottom and the removal of material can take place through this hole.

During the cleaning work the brush holders themselves will all the time adjust themselves to the walls of the cavity by pivoting of the arms 4 and the brush holders around the bearing points. This also takes place even if the wall of the cavity should be conical or otherwise designed with variable cross section. By the overlapping of the brush holders, so that an unbroken brush contour is provided, the whole circumference of the wall of the cavity is covered irrespective of the position of expansion of the arms 4. The fenders 15 during the work function serve as a protection for the arm mechanism and at the same time as a guide, so that the device will not place itself too eccentrically in the cavity, which could interfere with the function of the arms.

In case of wear the brushes 14 can be easily substituted and if the wear is not uniform, the substitution can be made sectionwise. It is within the scope of the invention that the brushes 14 can be substituted by other cleaning means, by way of example grinding plates or rakes, and a combination of different types of cleaning means can also be employed.

Finally it should be mentioned that it is not necessary that the device be used in a hanging position. If it is guided in a suitable manner, it can also be used for work in a horizontal direction.

I claim:

1. A cleaning device for cavities, preferably in chill molds for steel ingots, comprising an elongated support body, a plurality of lever means each having an upper end and a lower end, means on said body for pivotally mounting said lever means intermediate said ends about an axis perpendicular to the axis of said body, an elongated cleaning means pivotally mounted on the lower end of each of said lever means for pivotal movement about an axis parallel to the axis of said mounting means, each of said cleaning means having a cleaning surface facing away from said body, the said mounting means permitting the lower ends of said lever means and said cleaning means mounted thereon to expand outwardly, first spring means connected to said lever means to normally pivot said lower ends of said lever means outwardly from said body, second spring means connected between said cleaning means and said lever means to pivot said cleaning means so that the lower ends of said cleaning means extend inwardly toward said body forming an oblique angle with the axis of said body when said cleaning means are out of contact with the interior surface of a mold.

2. A cleaning device according to claim 1 in which the elongated cleaning means each decrease in width in a working direction, said cleaning means being mounted on said lever arms in such a manner that a cleaning means decreasing in width in one direction is adjacent a cleaning means decreasing in width in the opposite direction, said cleaning means being so positioned adjacent each other that the widest portion of one cleaning means overlaps the adjacent cleaning means as seen perpendicular to the expanding direction.

3. A cleaning device according to claim 1, in which an air nozzle is positioned on said body so as to contact the interior surface of a mold with an air jet.

* * * * *